US007540727B2

(12) United States Patent
Byun et al.

(10) Patent No.: US 7,540,727 B2
(45) Date of Patent: Jun. 2, 2009

(54) CAPACITY VARYING TYPE ROTARY COMPRESSOR

(75) Inventors: Sang-Myung Byun, Gyeongsangnam-Do (KR); Kang-Wook Cha, Gyeongsangnam-Do (KR); Seoung-Yeon Cho, Gyeongsangnam-Do (KR); Jin-Soo Kim, Gyeongsangnam-Do (KR); Geun-Hyoung Lee, Busan (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/663,330

(22) PCT Filed: Jan. 2, 2006

(86) PCT No.: PCT/KR2006/000008

§ 371 (c)(1),
(2), (4) Date: Mar. 21, 2007

(87) PCT Pub. No.: WO2006/090979

PCT Pub. Date: Aug. 31, 2006

(65) Prior Publication Data

US 2008/0056913 A1 Mar. 6, 2008

(30) Foreign Application Priority Data

| | | |
|---|---|---|
| Feb. 23, 2005 | (KR) | 10-2005-0015127 |
| Feb. 23, 2005 | (KR) | 10-2005-0015128 |
| Jul. 29, 2005 | (KR) | 10-2005-0069911 |
| Jul. 29, 2005 | (KR) | 10-2005-0069915 |
| Dec. 30, 2005 | (KR) | 10-2005-0136059 |

(51) Int. Cl.
*F03C 2/00* (2006.01)
*F04C 2/00* (2006.01)

(52) U.S. Cl. ..... 418/26; 418/11; 418/60; 418/178; 418/270; 417/220; 417/310

(58) Field of Classification Search ..... 418/11, 418/23, 60, 63, 270, 178, 179, 26; 417/220, 417/330, 440–442, 310, 312
See application file for complete search history.

(56) References Cited

U.S. PATENT DOCUMENTS 4,558,993 A * 12/1985 Hori et al. ..... 417/310

(Continued)

FOREIGN PATENT DOCUMENTS

CN 1467379 1/2004

(Continued)

OTHER PUBLICATIONS

Chinese Office Action dated Mar. 21, 2008.

*Primary Examiner*—Theresa Trieu
(74) *Attorney, Agent, or Firm*—Ked & Associates, LLP

(57) ABSTRACT

A capacity varying rotary compressor is provided. The compressor includes a cylinder mounted in a casing, and a vane pressure chamber provided at a rear side of a vane that divides an inner space of the cylinder into a suction chamber and a compression chamber. A pressure controlling unit supplies a discharge pressure or a suction pressure to the vane pressure chamber to thereby restrict or release a motion of the vane. A pressure leakage preventing unit couples the cylinder and bearings positioned at opposite sides of the cylinder to form the vane pressure chamber. A capacity to compress and discharge a refrigerant may be varied according to a load, thereby reducing power consumption of the compressor and simplifying assembly. Furthermore, pressure leakage from the vane pressure chamber may be prevented, thereby enhancing a capacity varying function.

4 Claims, 5 Drawing Sheets

U.S. PATENT DOCUMENTS

| | | | | |
|---|---|---|---|---|
| 6,176,687 | B1 * | 1/2001 | Kim et al. | 417/312 |
| 6,257,846 | B1 | 7/2001 | Muramatsu et al. | |
| 6,716,007 | B2 * | 4/2004 | Kim et al. | 418/26 |
| 6,932,588 | B2 * | 8/2005 | Choi et al. | 418/63 |
| 7,290,994 | B2 * | 11/2007 | Kitaichi et al. | 418/60 |
| 2004/0009083 | A1 | 1/2004 | Kim et al. | |
| 2004/0161345 | A1 * | 8/2004 | Choi et al. | 418/63 |

FOREIGN PATENT DOCUMENTS

| | | | |
|---|---|---|---|
| JP | 57129286 | | 8/1982 |
| JP | 58088486 | | 5/1983 |
| JP | 07035071 | A * | 2/1995 |
| JP | WO 2004/113731 | | 12/2004 |

* cited by examiner

CAPACITY VARYING TYPE ROTARY COMPRESSOR

TECHNICAL FIELD

The present invention relates to a rotary compressor, and more particularly, to a capacity varying type rotary compressor capable of varying a capacity to compress and discharge a refrigerant according to a load, capable of simplifying a structure thereof, and capable of enhancing a reliability by preventing a refrigerant leakage generated at the time of a capacity variation.

BACKGROUND ART

Generally, an air conditioner serves to maintain an indoor room as a comfortable state by maintaining an indoor temperature as a set temperature. The air conditioner comprises a refrigerating system. The refrigerating system comprises a compressor for compressing a refrigerant, a condenser for condensing a refrigerant compressed by the compressor and emitting heat outwardly, an expansion valve for lowering a pressure of a refrigerant condensed by the condenser, and an evaporator for evaporating a refrigerant that has passed through the expansion valve and absorbing external heat.

In the refrigerating system, when a compressor is operated as power is supplied thereto, a refrigerant of a high temperature and a high pressure discharged from the compressor sequentially passes through the condenser, the expansion valve, and the evaporator, and then is sucked into the compressor. The above process is repeated. In the above process, the condenser generates heat and the evaporator generates cool air by absorbing external heat. The heat generated from the condenser and the cool air generated from the evaporator are selectively circulated into an indoor room, thereby maintaining the indoor room as a comfortable state.

A compressor constituting the refrigerating system is various. Especially, a compressor applied to an air conditioner includes a rotary compressor, a scroll compressor, etc.

The most important factor in fabricating the air conditioner is to minimize a fabrication cost for a product competitiveness and to minimize a power consumption.

Especially, as an amount of oil usage is being increased worldwide, oil price is increased. Therefore, it is an important task to research an air conditioner to minimize a power consumption.

In order to minimize the power consumption of the air conditioner, the air conditioner is driven according to a load of an indoor room where the air conditioner is installed, that is, a temperature condition. That is, when the indoor temperature is drastically increased, the air conditioner is in a power mode so as to generate much cool air according to the drastic temperature variance (an excessive load). On the contrary, when the indoor temperature is varied with a small width, the air conditioner is in a saving mode so as to generate less cool air to maintain a preset indoor temperature.

In order to implement the modes, an amount of a refrigerant compressed by the compressor and discharged is controlled thereby to vary a refrigerating capacity of the refrigerating system.

As a method for controlling the amount of a refrigerant discharged from the compressor, an inverter motor is applied to the compressor thereby to vary an rpm of a driving motor of the compressor. An rpm of the driving motor of the compressor is controlled according to a load of an indoor room where the air conditioner is installed, and thus an amount of a refrigerant discharged from the compressor is controlled. An amount of heat generated from the condenser and cool air generated from the evaporator is controlled by varying the amount of a refrigerant discharged from the compressor.

However, in case of applying the inverter motor to the compressor, a fabrication cost is increased due to high price of the inverter motor thereby to degrade a price competitiveness.

DISCLOSURE OF THE INVENTION

Therefore, an object of the present invention is to provide a capacity varying type rotary compressor capable of varying a capacity to compress and discharge a refrigerant according to a load, capable of simplifying a structure thereof, and capable of enhancing a reliability by preventing a refrigerant leakage generated at the time of a capacity variation.

To achieve these and other advantages and in accordance with the purpose of the present invention, as embodied and broadly described herein, there is provided a capacity varying type rotary compressor, comprising: a cylinder mounted in a casing having a discharge pressure state; a vane pressure chamber provided at a rear side of a vane that divides an inner space of the cylinder into a suction chamber and a compression chamber with a rotation shaft inserted into the cylinder thus to be rotated or a rolling piston inserted into the rotation shaft; a pressure controlling unit for supplying a discharge pressure or a suction pressure to the vane pressure chamber and thereby restricting or releasing a motion of the vane; and a pressure leakage preventing couple unit for coupling the cylinder and bearings positioned at both sides of the cylinder and forming the vane pressure chamber with the cylinder to each other, and thereby preventing a pressure leakage of the vane pressure chamber.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODES FOR CARRYING OUT THE PREFERRED EMBODIMENTS

Reference will now be made in detail to the preferred embodiments of the present invention, examples of which are illustrated in the accompanying drawings.

Hereinafter, a capacity varying type rotary compressor according to the present invention will be explained in more detail with reference to the attached drawings.

Figure 1:
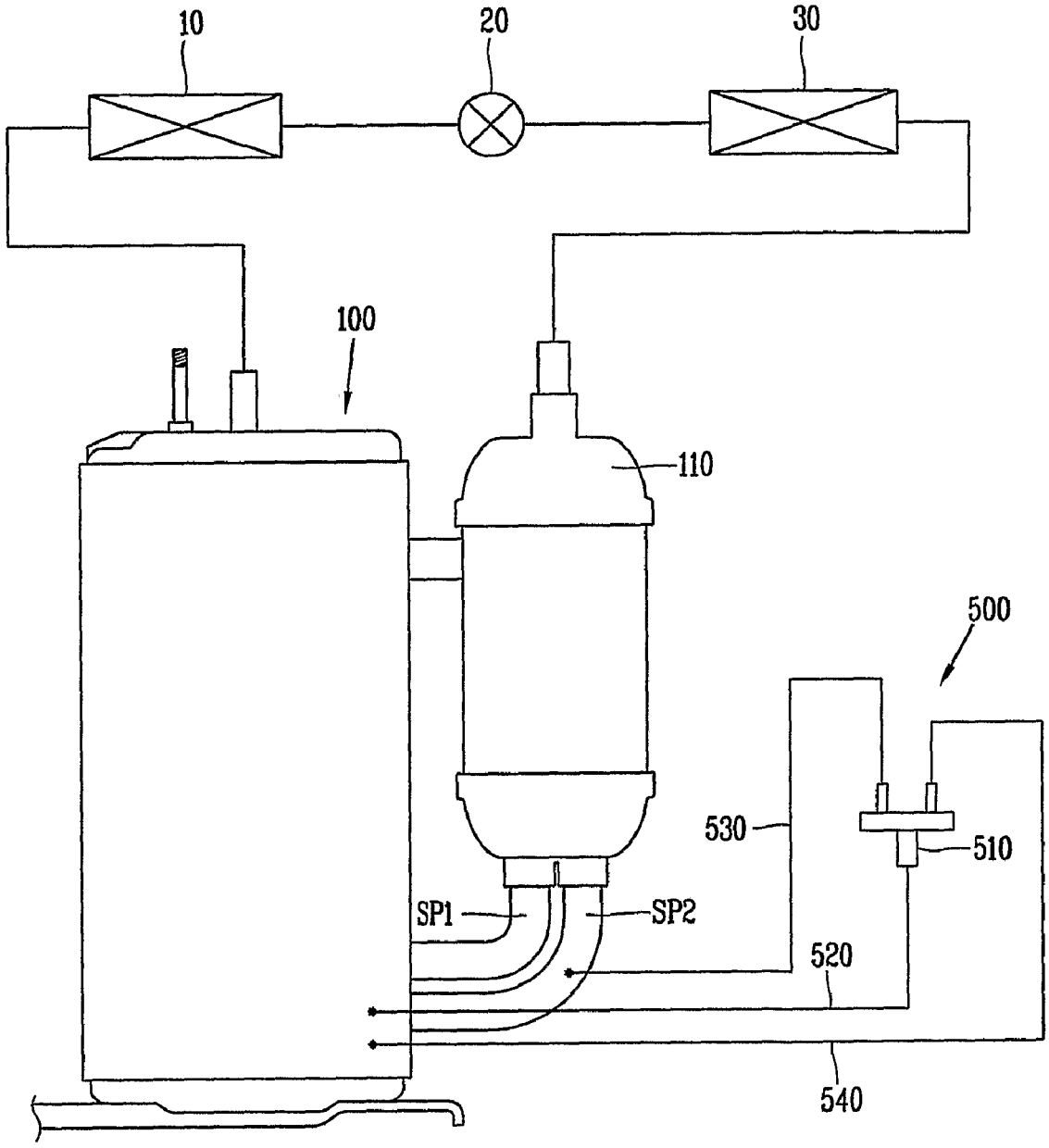
FIG. 1 is a piping diagram showing a refrigerating cycle system having a capacity varying type rotary compressor according to a first embodiment of the present invention.
Figure 2:
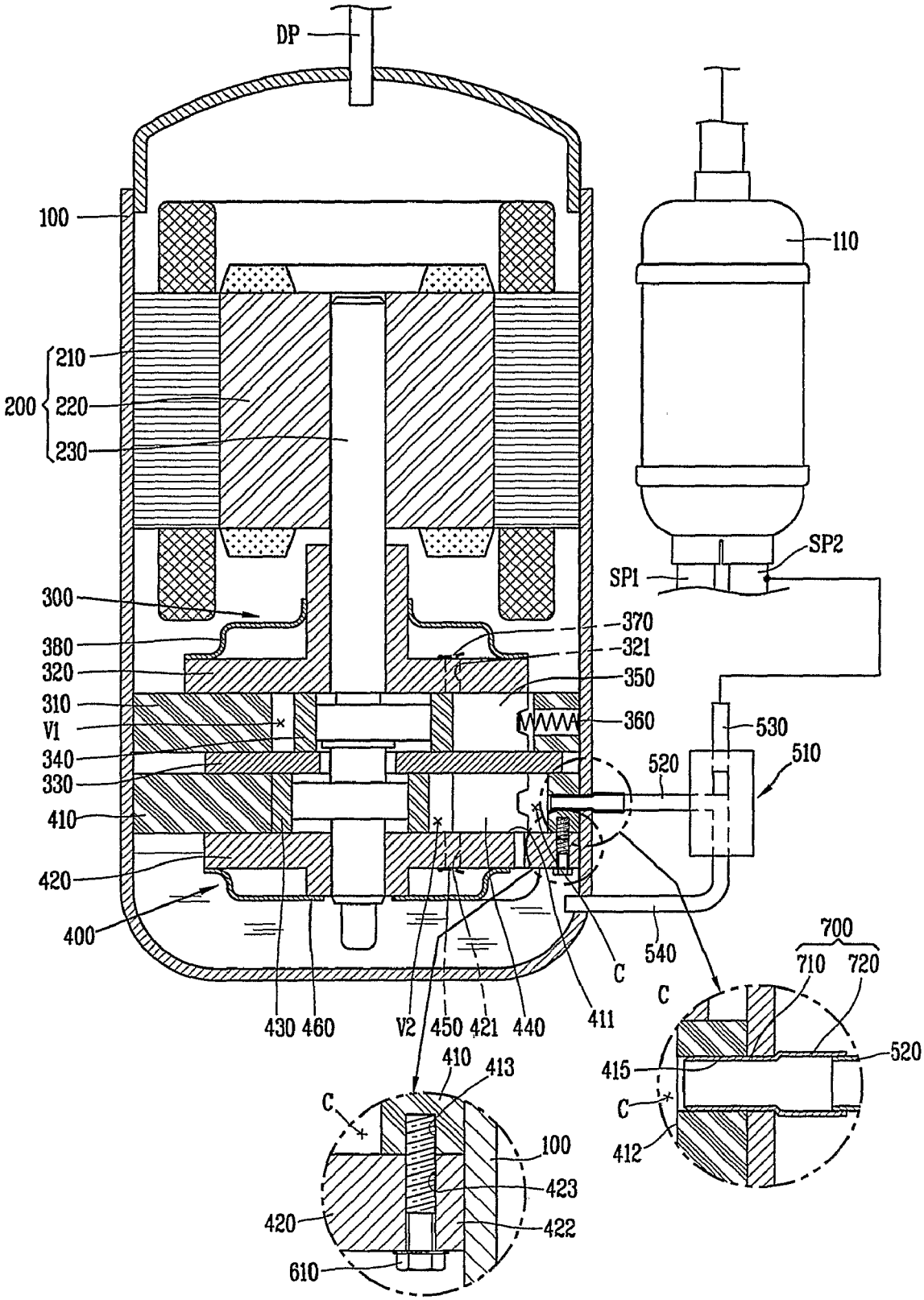
FIG. 2 is a sectional view showing the capacity varying type rotary compressor according to a first embodiment of the present invention.
Figure 3:
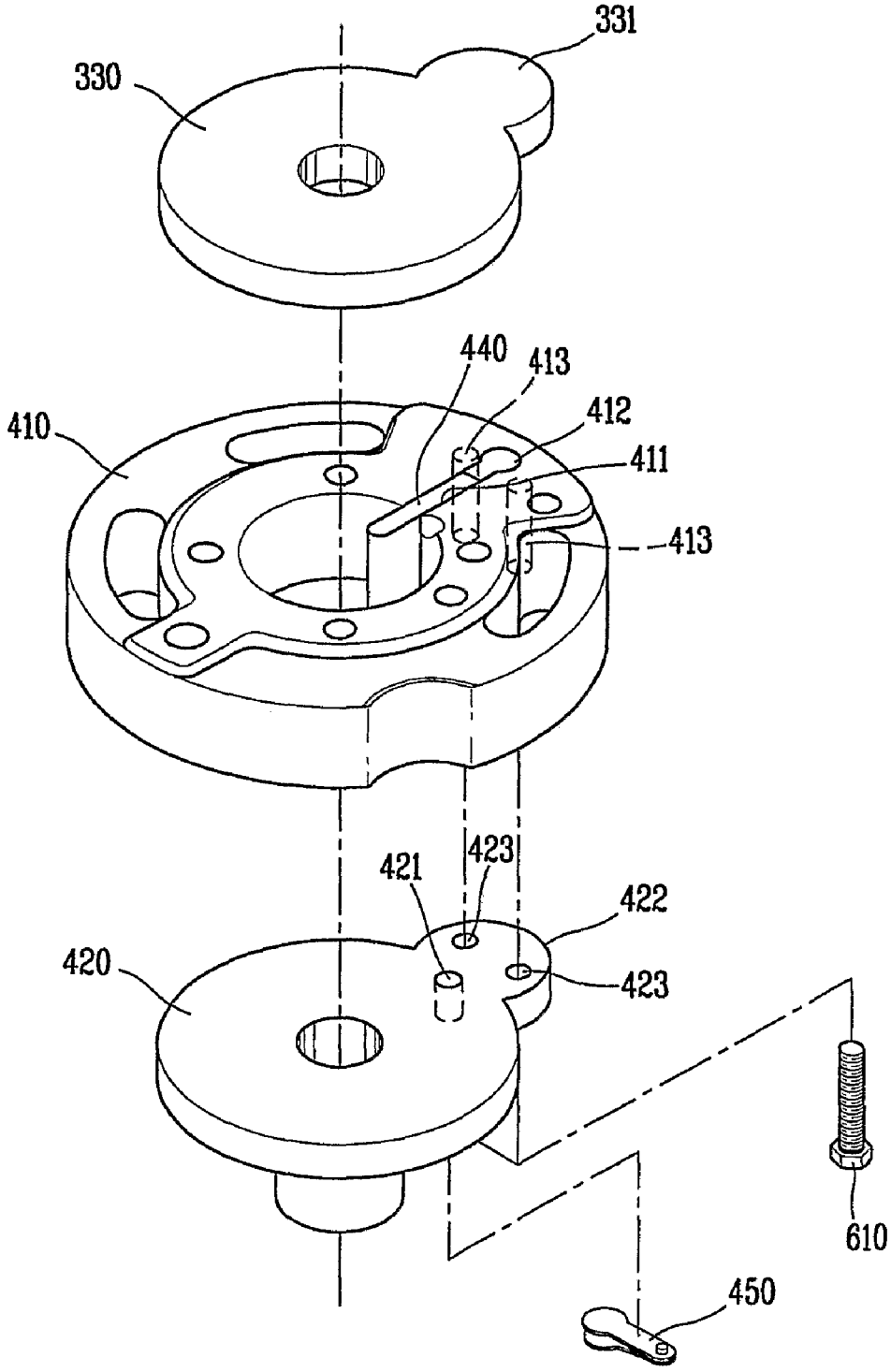
FIG. 3 is a perspective view showing a second compression part of the capacity varying type rotary compressor according to the present invention.

FIG. 1 is a piping diagram showing a refrigerating cycle system having a capacity varying type rotary compressor according to a first embodiment of the present invention, FIG. 2 is a sectional view showing the capacity varying type rotary compressor according to a first embodiment of the present invention, and FIG. 3 is a perspective view showing a second compression part of the capacity varying type rotary compressor according to the present invention.

As shown, the capacity varying type rotary compressor according to the present invention comprises a casing 100 to which a plurality of gas suction pipes SP1 and SP2 and one gas discharge pipe DP are connected, a motor part 200 installed at an upper side of the casing 100 and generating a rotation force, a first compression part 300 and a second compression part 400 installed at a lower side of the casing 100 for compressing a refrigerant by a rotation force generated from the motor part 200, a vane pressure chamber C positioned at a rear side of a second vane 440 constituting the second compression part 400, a pressure controlling unit for supplying a discharge pressure or a suction pressure to the vane pressure chamber C and thereby restricting or releasing a motion of the second vane 440, and a pressure leakage preventing couple unit for the cylinder and bearings positioned at both sides of the cylinder to each other and thereby preventing a pressure leakage of the vane pressure chamber C.

The motor part 200 comprises a stator 210 installed in the casing 100 and receiving power applied from outside, a rotor 220 disposed in the stator 210 with a certain air gap and rotated by being interacted with the stator 210, and a rotation shaft 230 coupled to the rotor 220 for transmitting a rotation force to the first compression part 300 and the second compression part 400. Preferably, the motor part performs a constant speed driving or a variable speed driving.

The first compression part 300 comprises a first cylinder 310 having a ring shape and installed in the casing 100, an upper bearing plate 320 (hereinafter, an upper bearing) and a middle bearing plate 330 (hereinafter, a middle bearing) covering upper and lower sides of the first cylinder 310 thereby forming a first compression space (V1) for supporting the rotation shaft 230 in a radial direction, a first rolling piston 340 rotatably coupled to an upper eccentric portion of the rotation shaft 230 and compressing a refrigerant with orbiting in the first compression space V1 of the first cylinder 310, a first vane 350 coupled to the first cylinder 310 to be movable in a radial direction so as to be in contact with an outer circumferential surface of the first rolling piston 340 for dividing the first space V1 of the first cylinder 310 into a first suction chamber and a first compression chamber, a vane supporting spring 360 for elastically supporting the first vane 350, a first discharge valve 370 coupled to the upper bearing 320 for opening and closing a first discharge opening 321 provided at the upper bearing 320, and a first muffler 380 coupled to the upper bearing for reducing noise.

The second compression part 400 comprises a second cylinder 410 having a ring shape and installed at a lower side of the first cylinder 310 inside the casing 100, a middle bearing 330 and a lower bearing plate 420 (hereinafter, will be called as a lower bearing) coupled to both sides of the second cylinder 410 for supporting the rotation shaft 230 in a radial direction and in a shaft direction, a second rolling piston 430 rotatably coupled to a lower eccentric portion of the rotation shaft 230 and compressing a refrigerant with orbiting in the second compression space V2 of the second cylinder 410, a second vane 440 coupled to the second cylinder 410 to be movable in a radial direction so as to contact/separate to/from an outer circumferential surface of the second rolling piston 430 for dividing the second space V2 of the second cylinder 410 into a second suction chamber and a second compression chamber or connecting the suction chamber and the compression chamber to each other, a second discharge valve 450 mounted at the lower bearing 420 for opening and closing a second discharge opening 421 provided at the lower bearing 420. A second muffler 460 for reducing noise is coupled to the lower bearing 420.

As shown in FIG. 3, the second cylinder 410 comprises a second vane slot 411 formed at one side of an inner circumferential surface thereof constituting the second compression space V2 for reciprocating the second vane 440 in a radial direction, a second inlet (not shown) formed at one side of the second vane slot 411 in a radial direction for introducing a refrigerant into the second compression space V2, and a second discharge guiding groove (not shown) formed at another side of the second vane slot 411 for discharging a refrigerant into the casing 100.

A vane pressure chamber C is provided at the second cylinder 410. The vane pressure chamber C is composed of a pressure space 412 formed at a rear side of the second vane slot 411 in a radial direction, and a middle bearing 330 and a lower bearing 420 respectively coupled to both sides of the second cylinder 410. The vane pressure chamber C is a hermetic space.

The middle bearing 330 and the lower bearing 420 comprise a body portion having a disc shape and having a size larger than an inner diameter of the second cylinder 410 and smaller than an outer diameter of the second cylinder 410, and extension portions 331 and 422 extending from one side of the body portion as a semi-circle shape and thereby covering the vane pressure chamber C.

Contact surfaces of the extension portions 331 and 422 to the second cylinder 410 are formed to have the same roughness as the surface constituting the compression space V2 of the second cylinder 410. Contact surfaces of the extension portions 331 and 422 to an edge portion of the vane pressure chamber 412 of the second cylinder 410 are formed to have a roughness less than 3 z with consideration of a sealing.

An oil through hole (not shown) for introducing oil contained in the casing 100 to the pressure space 412 of the vane pressure chamber C can be penetratingly formed at each middle portion of the extension portions 331 and 422 in a shaft direction.

The pressure leakage preventing couple unit couples the second cylinder 410 and the lower bearing 420 or the second cylinder 410 and the middle bearing 330 in order to prevent a pressure leakage of the vane pressure chamber C. The pressure leakage preventing couple unit is a partial coupling bolt 610 for coupling the extension portion 422 of the lower bearing 420 and a lower surface of the second cylinder 410. The partial coupling bolt 610 can couple the second cylinder 410 and the middle bearing 330 to each other. More specifically, through holes 423 are formed at the extension portion 422 of the lower bearing 420 with a certain gap, and coupling grooves 413 are respectively formed at both sides of the pressure space 412 of the second cylinder 410. The partial coupling bolt 610 is coupled to the through hole 423 and the coupling groove 413. The partial coupling bolt 610 is coupled to the middle bearing and the second cylinder by the same method as the aforementioned method.

The partial coupling bolt 610 couples the second cylinder 410 and the lower bearing 420 to each other and the second cylinder 410 and the middle bearing 330 to each other near the vane pressure chamber C, thereby enhancing a sealing degree of the vane pressure chamber C.

Figure 4:
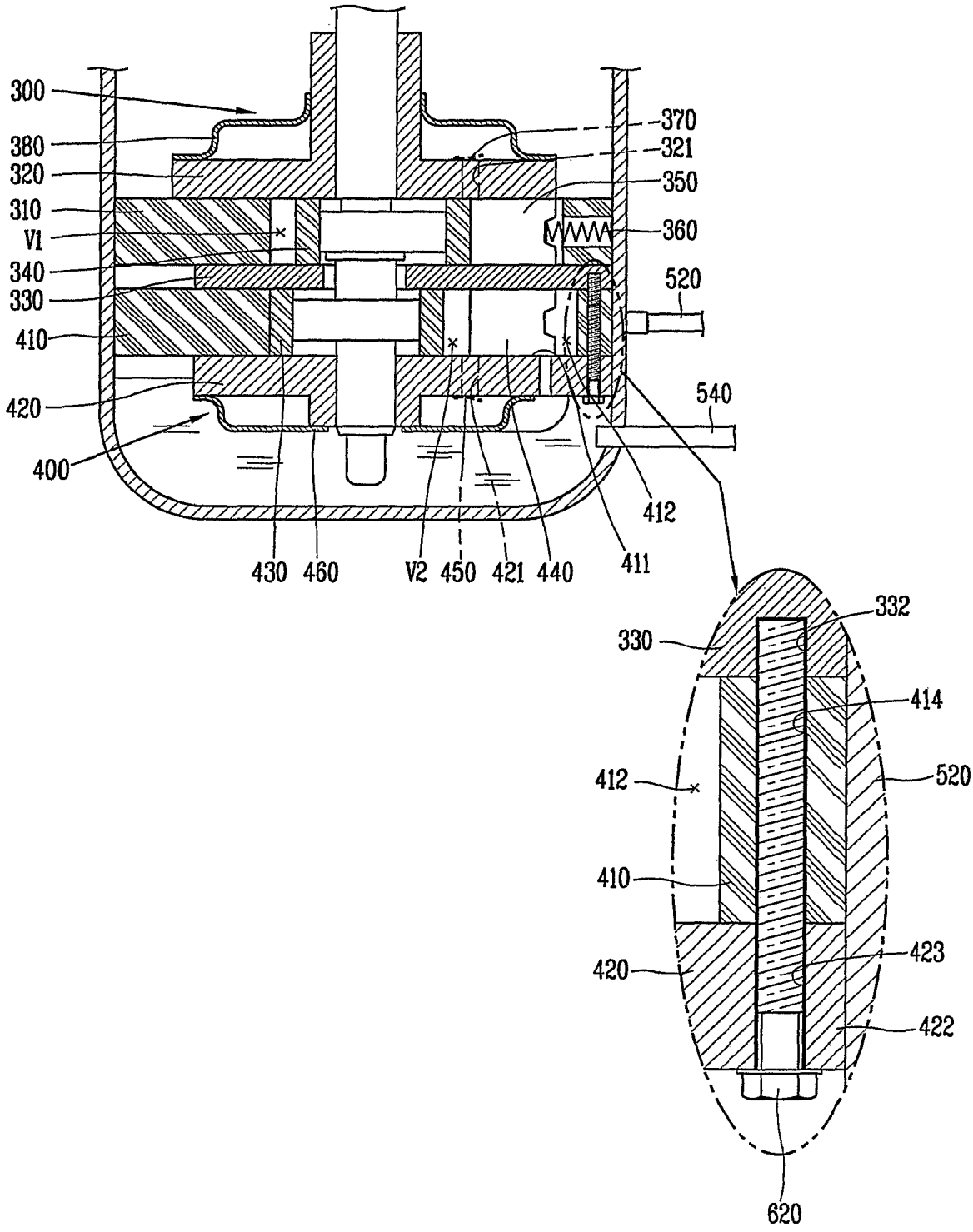
FIG. 4 is a sectional view showing a pressure leakage preventing couple unit of the capacity varying type rotary compressor according to the present invention.

As another modification example of the pressure leakage preventing couple unit, as shown in FIG. 4, there is provided a through coupling bolt 620 for coupling the second cylinder 410, the middle bearing 330, and the lower bearing 420, the middle and lower bearings positioned at both sides of the second cylinder 410. More specifically, through holes 423 and 414 are formed at the lower bearing 420 and the second cylinder 410 so as to be positioned at both sides of the vane. A coupling groove 332 is formed at a lower surface of the middle bearing 330 corresponding to the through hole. The through coupling bolt 620 couples the through holes 423 and 414 and the coupling groove 332. As the through coupling bolt 620 integrally couples the lower bearing 420, the middle bearing 330, and the second cylinder 410, a sealing intensity of the vane pressure chamber C is enhanced and an assembly process is simplified.

The upper bearing 320, the first cylinder 310, the middle bearing 330, the second cylinder 410, and the lower bearing 420 are coupled to one another by a plurality of coupling bolts (not shown).

The pressure controlling unit 500 comprises a mode switching valve 510 for connecting a common side connection pipe 520 that will be later explained to a suction side connection pipe 530 and a discharge side connection pipe 540 and thereby forming an inner pressure of the vane pressure chamber C as a suction pressure and a discharge pressure, a common side connection pipe 520 connected to one side of the mode switching valve 510 for connecting the mode switching valve 510 to the pressure space 412 of the second cylinder 420, a suction side connection pipe 530 connected to another side of the mode switching valve 510 for connecting the mode switching valve 510 to the second gas suction pipe SP2, and a discharge side connection pipe 540 connected to another side of the mode switching valve 510 for connecting the mode switching valve 510 to the inner space of the casing 100.

Preferably, the discharge side connection pipe 540 is connected to a lower portion of the inner space of the casing 100 that is lower than an oil surface in order to smoothly introduce oil into the vane pressure chamber C at the time of a normal driving.

A connection unit 700 for preventing a pressure leakage is provided between the common side connection pipe 520 of the pressure controlling unit 500 and the vane pressure chamber C.

The connection unit 700 for connecting the vane pressure chamber C and outside of the casing 100 to each other is a step-type connection tube having a first pipe portion 710 and a second pipe portion 720. The first pipe portion 710 is penetratingly inserted into the second cylinder 410 and the casing 100. Also, the second pipe portion 720 is extending from the first pipe portion 710 so as to have an inner diameter larger than an inner diameter of the first pipe portion 710, and the common side connection pipe 520 is coupled to the second pipe portion 720.

The first pipe portion 710 and the second pipe portion 720 of the step-type connection tube can be formed of the same material or different materials.

When the first pipe portion 710 and the second pipe portion 720 of the step-type connection tube are formed of different materials, the first pipe portion 710 is preferably formed of steel and the second pipe portion 720 is formed of copper. When the first pipe portion 710 is formed of steel and the second pipe portion 720 is formed of copper, the first pipe portion 710 can be coupled to a tube hole 415 formed at the second cylinder 410 through the casing 100 with a small deformation and the second pipe portion 720 can have an excellent welding characteristic with the common side connection pipe 520. The tube hole 415 is formed to penetrate the vane pressure chamber C of the second cylinder 410 and an outer circumferential surface of the second cylinder 410.

When the step-type connection tube is formed of the same material, the material is preferably copper.

The common side connection pipe 520 is formed of copper.

Figure 5:
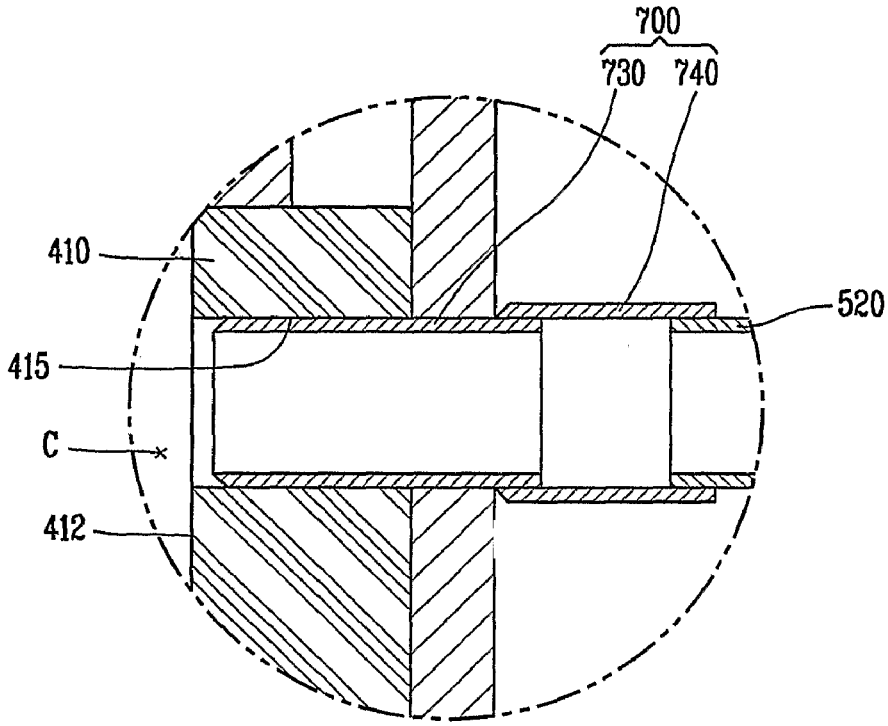
FIGS. 5 and 6 are sectional views respectively showing preferred embodiments of a connection unit of the capacity varying type rotary compressor according to the present invention.

According to another embodiment of the connection unit 700, as shown in FIG. 5, the connection unit comprises a first connection tube 730 having a certain inner diameter and length and penetratingly inserted into the second cylinder 410 and the casing 100 for connecting the vane pressure chamber C and outside of the casing 100 to each other, and a second connection tube 740 having an inner diameter corresponding to an outer diameter of the first connection tube and a certain length. One side of the second connection tube 740 is coupled to the first connection tube 730, and another side thereof is connected to the common side connection pipe 520.

Preferably, the first connection tube 730 and the second connection tube 740 are connected to each other by a welding. The first connection tube 730 and the second connection tube 740 can be formed of the same material or different materials.

When the first connection tube 730 and the second connection tube 740 are formed of different materials, the first connection tube 730 is preferably formed of steel and the second connection tube 740 is formed of copper. When the first connection tube 730 is formed of steel and the second connection tube 740 is formed of copper, the first connection tube 730 can be coupled to the tube hole 415 formed at the second cylinder 410 through the casing 100 with a small deformation and the second connection tube 740 can have an excellent welding characteristic with the first connection tube 730 and the common side connection pipe 520.

Figure 6:
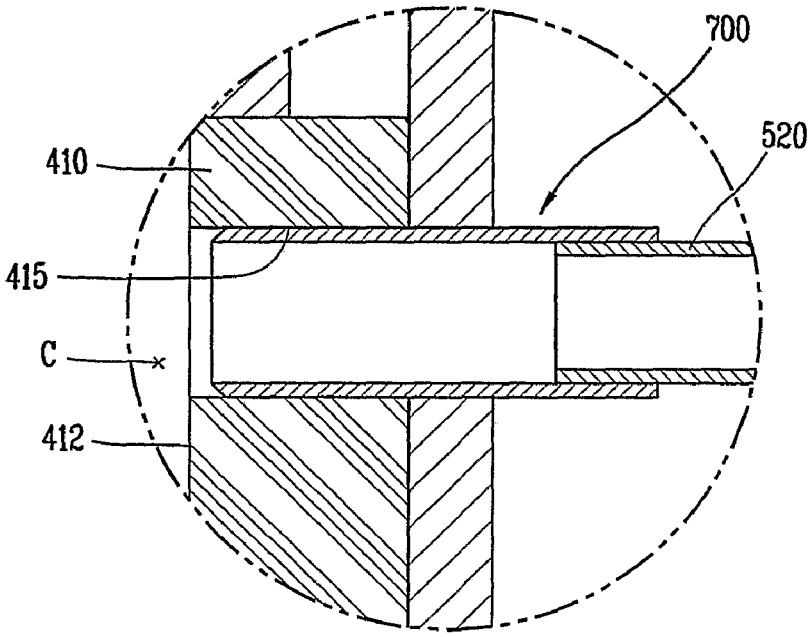

According to still another embodiment of the connection unit 700, as shown in FIG. 6, there is provided a linear connection tube having a certain inner diameter and length and penetratingly inserted into the second cylinder 410 and the casing 100 for connecting the vane pressure chamber C and outside of the casing 100 to each other. The common side connection pipe 520 is coupled to one side of the connection unit 700.

The linear connection tube positioned at the second cylinder 410 and the casing 100 is formed of steel, and the linear connection tube coupled to the common side connection pipe 520 is formed of copper.

Unexplained reference numeral 10 denotes a condenser, 20 denotes an expansion device, 30 denotes an evaporator, and 110 denotes an accumulator.

An operation of the capacity varying type rotary compressor according to the present invention will be explained.

When the rotor 220 is rotated as power is supplied to the stator 210 of the motor part 200, the rotation shaft 230 is rotated together with the rotor 220 thereby to transmit a rotation force of the motor part 200 to the first compression part 300 and the second compression part 400. When the first compression part 300 and the second compression part 400 are together normally driven, a cooling capacity of a large capacitance is generated. However, when the first compression part 300 performs a normal driving and the second compression part 400 performs a saving driving, a cooling capacity of a small capacitance is generated.

When the compressor or an air conditioner having the same is in a power mode, the mode switching valve 510 is operated and thus the discharge side connection pipe 540 and the common side connection pipe 520 are connected to each other. As the result, oil of a high pressure is introduced into the vane pressure chamber C of the second cylinder 410. The second vane 440 is retreated by a pressure of the oil thereby to be in contact with the second rolling piston 430, and normally compresses refrigerant gas introduced into the second compression space V2 and discharges the refrigerant gas.

The first vane 350 and the second vane 440 are respectively in contact with the rolling pistons 340 and 430, divide the first compression space V1 and the second compression space V2 into a suction chamber and a compression chamber, and compress refrigerant sucked into each suction chamber and then discharge the refrigerant. As the result, the compressor or an air conditioner having the same performs a driving of 100%.

When the compressor or an air conditioner using the same is in a saving mode likewise the initial driving, the mode switching valve 510 is operated in an opposite way to the normal driving thereby to connect the suction side connection pipe 530 and the common side connection pipe 520 to each other. Accordingly, a refrigerant of a low pressure sucked into the second cylinder 410 is partially introduced into the vane pressure chamber C. As the result, the second vane 440 is retreated to the vane pressure chamber C having a low pressure by the pressure of the second compression space V2, and thus the suction chamber and the compression chamber of the second compression space V2 are connected to each other. Accordingly, the refrigerant sucked into the second compression space V2 is not compressed. As the compression chamber and the suction chamber of the second cylinder 410 are connected to each other, the refrigerant sucked into the suction chamber of the second cylinder 410 is not compressed but is re-moved to the suction chamber along a locus of the second rolling piston 430. Accordingly, the second compression part 400 does not compress the refrigerant, and thus the compressor or the air conditioner using the same performs a driving only with a capacity of a refrigerant compressed by the first compression part 300.

The extension portions 331 and 422 of the middle bearing 330 and the lower bearing 420 are processed to have a roughness of approximately 3z with consideration of a sealing. The extension portions 331 and 422 near the vane pressure chamber C are coupled to the second cylinder 410 by using the partial coupling bolt 610 or the through coupling bolt 620, so that the vane pressure chamber C of the second cylinder 410 becomes hermetic by the extension portions 331 and 422 of the bearings 330 and 420. As the vane pressure chamber C becomes hermetic, even if a refrigerant of a high pressure or a low pressure or oil is supplied to the vane pressure chamber C, the refrigerant or the oil is prevented from being leaked to the inner space of the casing 100.

In the present invention, the connection unit 700 is provided between the vane pressure chamber C and the common side connection pipe 520, thereby preventing a refrigerant of a high pressure inside the casing 100 from being leaked to the vane pressure chamber C and outside of the casing 100. More concretely, when the common side connection pipe 520 formed of copper is coupled to the tube hole 415 of the cylinder through the casing 100, the common side connection pipe 520 is deformed since the casing 100 and the second cylinder 410 are formed of steel having a larger intensity than the copper, and the refrigerant of a high pressure inside the casing 100 is leaked between the common side connection unit 700 and the tube hole 415. However, in the present invention, the connection unit 700 is formed of steel at the coupled part to the tube hole 415 of the cylinder and the casing 100, and is formed of copper having an excellent welding characteristic at the coupled part to the common side connection pipe 520. Accordingly, when the connection unit is coupled to the second cylinder 410 and the casing 100, the deformation of the connection unit 700 is prevented thereby to prevent a pressure leakage. Also, the connection unit 700 can be coupled to the common side connection pipe 520 with an excellent welding characteristic.

Furthermore, in the conventional method, when the common side connection pipe 520 is directly inserted into the casing 100 and the second cylinder 410 in order to be connected to the vane pressure chamber C, the coupling operation was difficult since the common side connection pipe 520 is curvedly formed. However, in the present invention, the connection unit 700 is provided between the common side connection pipe 520 and the vane pressure chamber C. Therefore, the connection unit 700 is inserted into the casing 100 and the second cylinder 400, and the common side connection pipe 520 is inserted into the connection unit 700 thereby to facilitate the coupling operation.

In the preferred embodiment, the vane pressure chamber was provided at the second compression part. However, the vane pressure chamber can be provided at the first compression part or at the first and second compression parts.

As aforementioned, the capacity varying type rotary compressor according to the present invention, a capacity to compress and discharge a refrigerant is varied according to a load and an entire construction thereof is simplified, thereby reducing consumption power of the compressor or an air conditioner having the same and enhancing an assembly characteristic due to a simplified assembly process.

Furthermore, a pressure leakage of the vane pressure chamber to which a discharge pressure and a suction pressure are applied is prevented, thereby enhancing a capacity varying function and thus enhancing a reliability.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A capacity varying rotary compressor, comprising:

a first cylinder and a second cylinder provided in a casing, the first and second cylinders being coupled to a rotary shaft by first and second rolling pistons;

an upper bearing positioned at an upper surface of the first cylinder, a middle bearing positioned between a lower surface of the first cylinder and an upper surface of the second cylinder, and a lower bearing positioned at a lower surface of the second cylinder;

a vane that divides an inner space of the second cylinder into a suction chamber and a compression chamber;

a vane pressure chamber formed at a rear portion of the vane, defined by the second cylinder and the middle and lower bearings;

a pressure controlling unit that supplies a discharge pressure or a suction pressure to the vane pressure chamber so as to restrict or release a motion of the vane;

a connection unit that extends from a connection pipe of the pressure controlling unit, through the casing, and to the vane pressure chamber formed in the second cylinder so as to supply the discharge pressure or the suction pressure to the vane pressure chamber; and a coupling unit that couples the cylinder and the middle and lower bearings to each other so as to prevent a leakage of pressure from the vane pressure chamber, wherein the vane pressure chamber comprises a pressure space that extends from a vane slot formed in the second cylinder, and wherein the coupling unit is coupled to extension portions of each of the first middle and second lower bearings such that the extension portions hermetically seal the pressure space of the second cylinder.

2. A capacity varying rotary compressor, comprising:

a first cylinder and a second cylinder provided in a casing, the first and second cylinders being coupled to a rotary shaft by first and second rolling pistons;

an upper bearing positioned at an upper surface of the first cylinder, a middle bearing positioned between a lower surface of the first cylinder and an upper surface of the second cylinder, and a lower bearing positioned at a lower surface of the second cylinder;

a vane that divides an inner space of the second cylinder into a suction chamber and a compression chamber;

a vane pressure chamber formed at a rear portion of the vane, defined by the second cylinder and the middle and lower bearings;

a pressure controlling unit that supplies a discharge pressure or a suction pressure to the vane pressure chamber so as to restrict or release a motion of the vane;

a connection unit that extends from a connection pipe of the pressure controlling unit, through the casing, and to the vane pressure chamber formed in the second cylinder so as to supply the discharge pressure or the suction pressure to the vane pressure chamber, wherein the connection unit is a stepped connection tube comprising:

a first pipe portion that penetrates through the casing and into the second cylinder so as to connect the vane pressure chamber to an outside of the casing; and a second pipe portion that extends from the first pipe portion to the connection pipe, wherein the first pipe portion of the stepped connection tube is formed of steel, and the second pipe portion of the stepped connection tube is formed of copper; and a coupling unit that couples the cylinder and the middle and lower bearings to each other so as to prevent a leakage of pressure from the vane pressure chamber.

3. A capacity varying rotary compressor, comprising:

a first cylinder and a second cylinder provided in a casing, the first and second cylinders being coupled to a rotary shaft by first and second rolling pistons;

an upper bearing positioned at an upper surface of the first cylinder, a middle bearing positioned between a lower surface of the first cylinder and an upper surface of the second cylinder, and a lower bearing positioned at a lower surface of the second cylinder;

a vane that divides an inner space of the second cylinder into a suction chamber and a compression chamber;

a vane pressure chamber formed at a rear portion of the vane, defined by the second cylinder and the middle and lower bearings;

a pressure controlling unit that supplies a discharge pressure or a suction pressure to the vane pressure chamber so as to restrict or release a motion of the vane;

a connection unit that extends from a connection pipe of the pressure controlling unit, through the casing, and to the vane pressure chamber formed in the second cylinder so as to supply the discharge pressure or the suction pressure to the vane pressure chamber, wherein the connection unit comprises:

a first connection tube that penetrates through the casing and into the second cylinder so as to connect the vane pressure chamber to an outside of the casing; and a second connection tube having a first end coupled to the first connection tube and a second end coupled to the connection pipe, wherein an inner diameter of the second connection tube corresponds to an outer diameter of the first connection tube, and wherein the first connection tube is formed of steel, and the second connection tube is formed of copper; and a coupling unit that couples the cylinder and the middle and lower bearings to each other so as to prevent a leakage of pressure from the vane pressure chamber.

4. A capacity varying rotary compressor, comprising:

a first cylinder and a second cylinder provided in a casing, the first and second cylinders being coupled to a rotary shaft by first and second rolling pistons;

an upper bearing positioned at an upper surface of the first cylinder, a middle bearing positioned between a lower surface of the first cylinder and an upper surface of the second cylinder, and a lower bearing positioned at a lower surface of the second cylinder;

a vane that divides an inner space of the second cylinder into a suction chamber and a compression chamber;

a vane pressure chamber formed at a rear portion of the vane, defined by the second cylinder and the middle and lower bearings;

a pressure controlling unit that supplies a discharge pressure or a suction pressure to the vane pressure chamber so as to restrict or release a motion of the vane;

a connection unit that extends from a connection pipe of the pressure controlling unit, through the casing, and to the vane pressure chamber formed in the second cylinder so as to supply the discharge pressure or the suction pressure to the vane pressure chamber, wherein the connection unit comprises:

a first connection tube that penetrates through the casing and into the second cylinder so as to connect the vane pressure chamber to an outside of the casing; and a second connection tube having a first end coupled to the first connection tube and a second end coupled to the connection pipe, wherein an inner diameter of the second connection tube corresponds to an outer diameter of the first connection tube, and wherein the first connection tube is formed of steel, the second connection tube is formed of copper, and the connection pipe is formed of copper; and a coupling unit that couples the cylinder and the middle and lower bearings to each other so as to prevent a leakage of pressure from the vane pressure chamber.

* * * * *